US010006234B2

(12) United States Patent
Minkovich et al.

(10) Patent No.: US 10,006,234 B2
(45) Date of Patent: Jun. 26, 2018

(54) GUIDE BLOCK FOR GLASS PANEL

(71) Applicant: Bath Authority LLC, Warminster, PA (US)

(72) Inventors: Michael Minkovich, Richboro, PA (US); Vadym Mironchuk, Southampton, PA (US); Brian Lieb, Philadelphia, PA (US)

(73) Assignee: BATH AUTHORITY LLC, Warminster, PA (US)

( * ) Notice: Subject to any disclaimer, the term of this patent is extended or adjusted under 35 U.S.C. 154(b) by 103 days.

(21) Appl. No.: 15/215,820

(22) Filed: Jul. 21, 2016

(65) Prior Publication Data

US 2018/0020882 A1 Jan. 25, 2018

(51) Int. Cl.
*E05D 15/06* (2006.01)
*A47K 3/34* (2006.01)
*E06B 3/02* (2006.01)

(52) U.S. Cl.
CPC ..... *E05D 15/0656* (2013.01); *A47K 3/34* (2013.01); *E05D 15/063* (2013.01); *E06B 3/02* (2013.01)

(58) Field of Classification Search
CPC . A47K 3/34; A47K 3/36; A47K 3/362; E05D 15/0656; Y10T 16/37
USPC ..... 49/513, 125, 61; 16/90
See application file for complete search history.

(56) References Cited

U.S. PATENT DOCUMENTS 1,876,881 A * 9/1932 Durant ..... E05C 17/54 16/82
2,750,622 A * 6/1956 Stark ..... E05D 15/0656 16/90
2,939,167 A * 6/1960 Preston ..... E05D 15/0656 16/90
2,949,626 A * 8/1960 Blackmer ..... E05D 15/0656 16/90
3,000,046 A * 9/1961 Foltz ..... E05D 15/0656 16/90
3,205,529 A * 9/1965 Vintan ..... E05D 15/0656 16/90

(Continued)

FOREIGN PATENT DOCUMENTS

DE 10228874 A1 * 1/2004
DE 102004037938 B3 * 4/2006 ..... E05D 15/0656
DE 102010034641 A1 * 5/2011 ..... A47K 3/34

OTHER PUBLICATIONS

Information about Related Patents and Patent Applications, see section 6 of the accompanying Information Disclosure Statement Letter, which concerns Related Patents and Patent Applications.

*Primary Examiner* — Erin Deery
(74) *Attorney, Agent, or Firm* — Fox Rothschild LLP

(57) ABSTRACT

A guide block for stabilizing an edge of a glass panel relative to a surface is disclosed. The guide block includes a block base having a body of variable size and shape configured for mounting on the surface. The block base defines at least one fastening screw receiving hole on top and on a side thereof. The guide block further includes a mounting member having a pin extending therefrom an inner side of the mounting member. The block base has a front and a rear such that the front is configured to receive the pin in a hole therethrough such that the block base and the mounting member stabilize the edge of the glass panel disposed therebetween and the rear is configured as a receiving channel for stabilizing an edge of a sliding glass door disposed therein.

18 Claims, 5 Drawing Sheets

(56) References Cited

U.S. PATENT DOCUMENTS

| | | | | |
|---|---|---|---|---|
| 3,454,979 | A * | 7/1969 | Harbertson | E05D 15/0656 16/90 |
| 4,178,718 | A * | 12/1979 | Laby | A47K 3/34 49/411 |
| D275,247 | S | 8/1984 | Sherman | |
| 6,364,261 | B1 | 4/2002 | Vass, Jr. | |
| D490,697 | S | 6/2004 | Runnalls | |
| D504,609 | S | 5/2005 | Ferguson | |
| D547,637 | S | 7/2007 | Blacker | |
| D556,558 | S | 12/2007 | Biancardi et al. | |
| D614,483 | S | 4/2010 | Leibe, III | |
| D615,847 | S | 5/2010 | Tezak et al. | |
| D616,276 | S | 5/2010 | Friegang | |
| D622,131 | S | 8/2010 | Tezak et al. | |
| D626,821 | S | 11/2010 | Hikoyama | |
| D627,211 | S | 11/2010 | Hikoyama | |
| D627,212 | S | 11/2010 | Hikoyama | |
| D651,503 | S | 1/2012 | Ellis | |
| D662,805 | S | 7/2012 | Macdonald et al. | |
| D666,902 | S | 9/2012 | Berger | |
| D727,716 | S | 4/2015 | Langle | |
| D735,017 | S | 7/2015 | Langle | |
| 9,127,491 | B2 | 9/2015 | Bouthillier | |
| D742,969 | S | 11/2015 | White | |
| D747,225 | S | 1/2016 | Decook et al. | |
| D756,211 | S | 5/2016 | Downs | |
| 9,382,737 | B2 * | 7/2016 | Wei | E05D 15/0656 |
| D763,670 | S | 8/2016 | Monsees | |
| D777,024 | S | 1/2017 | Lee et al. | |
| D781,681 | S | 3/2017 | Nagaki et al. | |
| 2003/0019030 | A1 | 1/2003 | Kopacz et al. | |
| 2005/0102958 | A1 | 5/2005 | Anderson | |
| 2010/0116448 | A1 | 5/2010 | Healam et al. | |
| 2014/0143980 | A1 | 5/2014 | Chang et al. | |
| 2015/0252603 | A1 | 9/2015 | Cianetti | |
| 2016/0138311 | A1 | 5/2016 | Kreyenborg | |
| 2016/0206157 | A1 | 7/2016 | Ball et al. | |
| 2016/0356073 | A1 * | 12/2016 | Chang | E05D 15/0656 |
| 2016/0369547 | A1 | 12/2016 | Sato | |
| 2017/0074021 | A1 | 3/2017 | Rodems et al. | |
| 2017/0292304 | A1 * | 10/2017 | Sidwell | E05D 15/0656 |

* cited by examiner

GUIDE BLOCK FOR GLASS PANEL

TECHNICAL FIELD

The present invention relates to the field of bathroom hardware, and more particularly, to a guide block for stabilizing an edge of a glass panel, for example, a glass panel of a shower enclosure.

BACKGROUND

For many years, the most commonly used enclosure for a tub/shower bathing facility has included a pair of sliding glass doors framed in metal. In a typical installation, an outer metal frame circumscribes the entry to the bath and is attached at the sides to the walls of the facility. The installation also includes a header spanning the entrance and a guide rail attached to the tub or shower base. The shower doors are hung at the top from the header and guided at the bottom by the rail so that they can slide back and forth in the entryway to allow entry and egress and to create a splash barrier.

There are several disadvantages with the described installation, both functional and aesthetic. First, the support structure is always present in the entryway to the bathing area, thus always at least partially blocking the entrance and restricting free access to the bathing area, a special problem when bathing a small child or when cleaning the facility. The header also adds an undesired obstruction in the entryway which must be avoided when entering or leaving the area. Moreover, the metal of the frame and all the glass-to-metal interfaces require special cleaning and maintenance. Apart from these functional constraints, the metal required for the framing, header and rail detracts from a clean and open appearance of the facility.

Various systems eliminating the shower door header have been utilized, including enclosure systems with the shower door hingedly or slidably connected to a glass panel, which is in turn mounted to an adjacent wall. Conventional enclosure systems are disadvantageous in that they use more hardware material than is desired and are hence heavier in appearance. In addition, conventional enclosure systems include many individual parts to assemble and install. Further, conventional enclosure systems include hardware that need to be installed before the stationary glass panel is installed, which can lead to an undesirable amount of glass breakage should the glass panel be lowered incorrectly by the installer.

It would thus be desirable to have an improved guide block for a glass panel, among other desirable features as described herein, while avoiding the disadvantages of the known conventional enclosure systems.

SUMMARY

In a first aspect, there is provided herein a guide block for stabilizing an edge of a glass panel relative to a surface. The guide block includes a block base having a body of variable size and shape configured for mounting on the surface. The block base defines at least one fastening screw receiving hole on top and on a side thereof. The guide block further includes a mounting member having a pin extending therefrom an inner side of the mounting member. The block base has a front and a rear such that the front is configured to receive the pin in a hole therethrough such that the block base and the mounting member stabilize the edge of the glass panel disposed therebetween and the rear is configured as a receiving channel for stabilizing an edge of a sliding glass door disposed therein.

In certain embodiments, the block base is geometrically shaped as a square or rectangle.

In certain embodiments, the surface is defined by a shower enclosure threshold frame.

In certain embodiments, the pin is configured to be angled at a distal end thereof.

In certain embodiments, the pin is configured to be cone-shaped at a distal end thereof.

In certain embodiments, the block base is mounted to the surface by tightening a screw through the at least one fastening screw receiving hole on the top of the block base.

In certain embodiments, a distal end of the pin is secured to the block base by tightening a set screw through the at least one fastening screw receiving hole on the side of the block base.

In certain embodiments, the mounting member is drawn tight against the glass panel upon the tightening of the set screw through the at least one fastening screw receiving hole on the side of the block base.

In certain embodiments, a bottom edge of the glass panel is configured to set atop the pin with a distal end of the pin secured inside the block base such that the glass panel is stabilized therebetween the block base and mounting member.

In certain embodiments, the receiving channel is configured to house a sliding base component for stabilizing a bottom edge of the glass door.

In certain embodiments, the sliding base component is multi-pronged and disc-shaped such that the bottom edge of the glass door is disposed therebetween the multi-pronged sliding base component to facilitate sliding of the bottom edge of the glass door relative to the surface.

In a second aspect, there is provided herein a guide block for stabilizing an edge of a glass panel relative to a surface. The guide block includes a block base having a body configured for mounting on the surface. The block base defines at least one fastening screw receiving hole on top and on a side thereof. The guide block further includes a mounting member having a pin extending therefrom an inner side of the mounting member. The block base has a front configured to receive the pin in a hole therethrough such that the block base and the mounting member stabilize the edge of the glass panel disposed therebetween.

In certain embodiments, the block base is geometrically shaped as a square or rectangle.

In certain embodiments, the surface is defined by a shower enclosure threshold frame.

In certain embodiments, the pin is configured to be angled at a distal end thereof.

In certain embodiments, the pin is configured to be cone-shaped at a distal end thereof.

In certain embodiments, the block base is mounted to the surface by tightening a screw through the at least one fastening screw receiving hole on the top of the block base.

In certain embodiments, a distal end of the pin is secured to the block base by tightening a set screw through the at least one fastening screw receiving hole on the side of the block base.

In certain embodiments, the mounting member is drawn tight against the glass panel upon the tightening of the set screw through the at least one fastening screw receiving hole on the side of the block base.

In certain embodiments, a bottom edge of the glass panel is configured to set atop the pin with a distal end of the pin secured inside the block base such that the glass panel is stabilized therebetween the block base and mounting member.

In a third aspect, there is provided herein a shower enclosure having a glass panel positioned along a surface defined by a shower enclosure threshold frame. The shower enclosure further includes a guide block according to an exemplary embodiment described herein with the mounting member and block base configured to stabilize a bottom edge of the glass panel therebetween and the receiving channel configured to stabilize a bottom edge of a sliding glass door therebetween such that the glass door is slidably disposed within the receiving channel.

In a fourth aspect, there is provided herein a shower enclosure having a glass panel positioned along a surface defined by a shower enclosure threshold frame. The shower enclosure further includes a guide block according to another exemplary embodiment described herein with the mounting member and block base configured to stabilize a bottom edge of the glass panel therebetween.

Various advantages of this disclosure will become apparent to those skilled in the art from the following detailed description, when read in light of the accompanying drawings.

DETAILED DESCRIPTION

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the present disclosure is not limited to the guide block having the specific sizes or dimensions recited herein. As used herein, the term "comprising" means "including, but not limited to."

In consideration of the figures, it is to be understood for purposes of clarity certain details of construction and/or operation are not provided in view of such details being conventional and well within the skill of the art upon disclosure of the document described herein. In the figures, like numerals indicate like elements throughout.

The present disclosure pertains to a guide block for stabilizing an edge of a stationary glass panel of a shower enclosure. The guide block increases the appearance of framelessness of the shower enclosure, reduces the total amount of hardware necessary, and reduces the amount of steps necessary in the installation process and hence requires less labor.

In addition to the advantages described above, the guide block allows the stationary glass panel to be installed first and the guide block installed after the glass is in place. The guide block accommodates a wide range of variances in glass thicknesses, such as 8 mm or 10 mm and the like. The guide block further allows use of a less damage-prone cut of stationary glass, among other desirable features as described herein.

Figure 1:
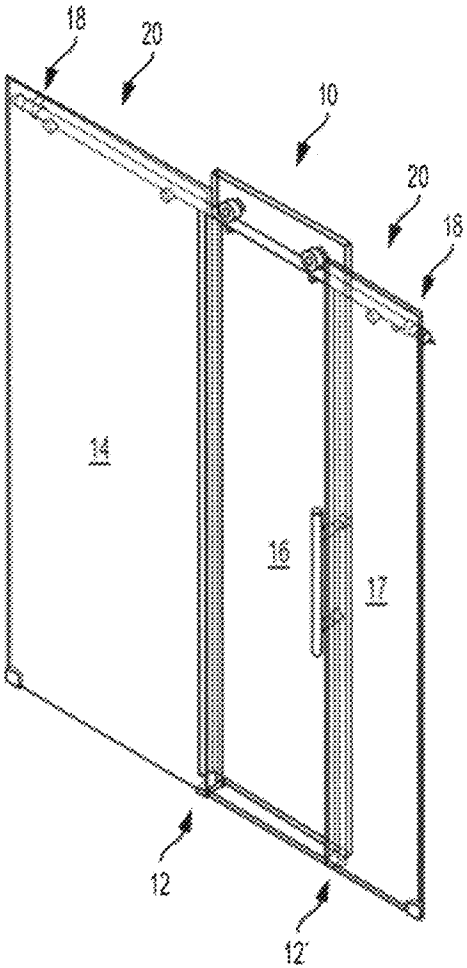
FIG. 1 is a perspective view of an exemplary shower enclosure incorporating a guide block for stabilizing an edge of a glass panel in accordance with an embodiment of the present disclosure.
Figure 5:
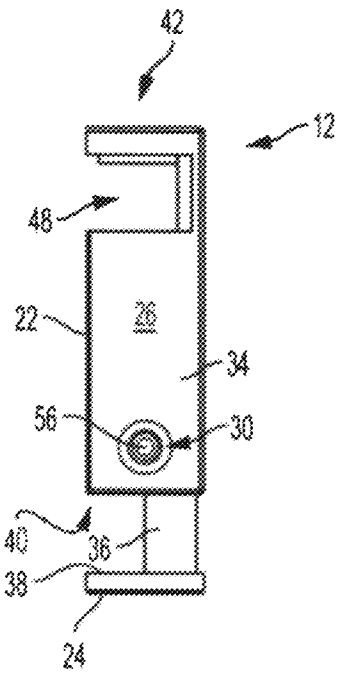
FIG. 5 is a side elevational view of the guide block of FIG. 3.
Figure 4:
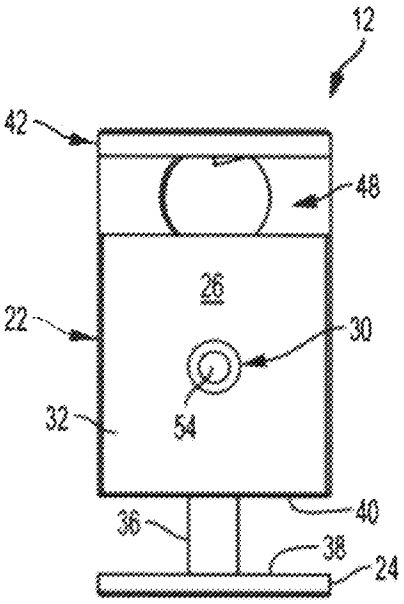
FIG. 4 is a top plan view of the guide block of FIG. 3.
Figure 3:
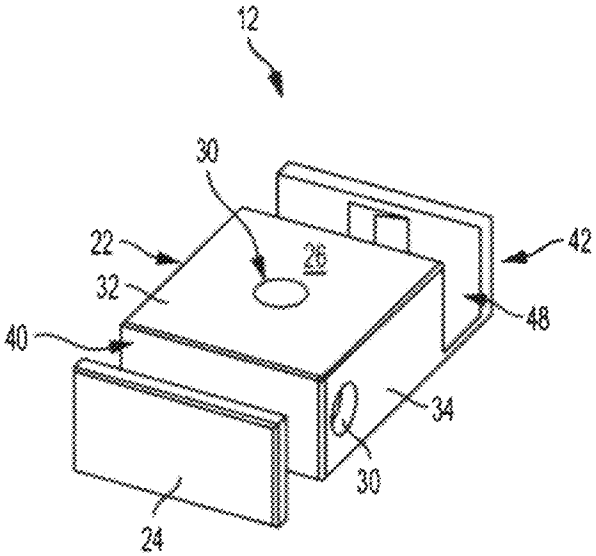
FIG. 3 is a side perspective view of the guide block of FIG. 2.

Referring now to FIG. 1 is a perspective view of an exemplary shower enclosure 10 incorporating a guide block 12 described in more detail below in accordance with an embodiment of the present disclosure. The shower enclosure 10 includes a glass panel 14 secured to a wall (not shown). A glass shower door 16 is slidably connected to the glass panel 14 and a stationary extension glass panel 17 via a rail bracket 18 disposed at top 20 of the shower enclosure 10. Such a configuration maintains a clean aesthetic appearance for the shower enclosure 10. It should be understood that the guide block 12 is not limited to the shower enclosure 10 illustrated in FIG. 1. The illustrated shower enclosure 10 in FIG. 1 is for illustration only as the guide block 12 may be utilized to stabilize a glass panel 14 in various shower enclosure configurations.

Figure 2:
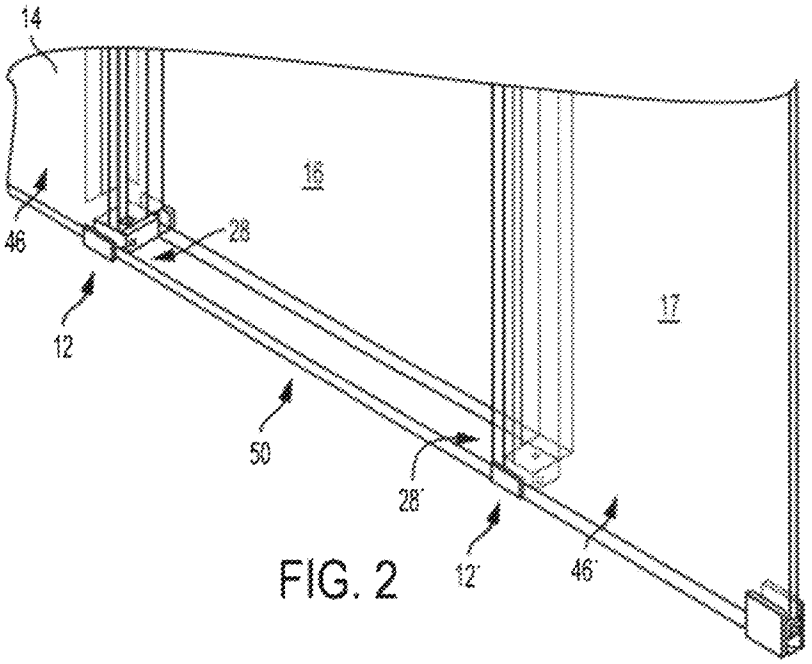
FIG. 2 is an up close, enlarged view of the guide block for glass panel incorporated into the exemplary shower enclosure of FIG. 1.

FIG. 2 is an up close, enlarged view of the guide block 12 for glass panel 14 incorporated into the exemplary shower enclosure 10 of FIG. 1. Another embodiment of the guide block 12' is shown to the right of guide block 12 and will be described in more detail below in connection with FIGS. 9-14. It should be understood that guide blocks 12 and 12' may be used to stabilize non-glass panels or shower doors in various shower enclosure configurations and are not limited for use with only glass panels or shower doors.

Referring now to FIGS. 3-8, the guide block 12 will be described in more detail. FIGS. 3-8 show various views of the guide block 12 in accordance with an exemplary embodiment of the present disclosure. The guide block 12 generally includes a block base 22 and a mounting member 24. The block base 22 has a body 26 of variable size and shape configured for mounting on a surface 28. The block base 22 has at least one fastening screw receiving hole 30 on top 32 and on a side 34 thereof. The mounting member 24 includes a pin 36 extending therefrom an inner side 38 of the mounting member. The block base 22 has a front 40 and a rear 42 such that the front is configured to receive the pin 36 in a hole 44 therethrough such that the block base and the mounting member 24 stabilize the edge 46 of the glass panel 14 disposed therebetween and the rear is configured as a receiving channel 48 for stabilizing an edge of a sliding glass shower door 16 disposed therein.

In the illustrated embodiment, the block base 22 is geometrically shaped as a square or rectangle. It should be understood that the guide block 12 can be configured of any suitable geometric shape and size. In particular, the guide block 12 can be produced in a wide variety of shapes and still maintain the core functionality, which is the use of one screw hole 30 on the top 32 and one screw hole on the side 34 of the block base 22 and the capacity for the mounting member 24 to be attached to the glass panel 14 after securing the block base.

In some embodiments, the surface 28, 28' is defined by a shower enclosure threshold frame 50 (see FIG. 2). It should be understood that the surface 28, 28' is the floor of the shower enclosure 10.

In some embodiments, the pin 36 is configured to be angled at a distal end 52 thereof. In other embodiments, the pin 36 is configured to be cone-shaped at a distal end 52 thereof. It should be understood that the pin 36 can be configured of any suitable geometric shape in accordance with the present disclosure.

In accordance with an exemplary embodiment of the present disclosure, the block base 22 is mounted to the surface 28 by tightening a screw 54 through the at least one fastening screw receiving hole 30 on the top 32 of the block base 22.

In accordance with another exemplary embodiment of the present disclosure, the distal end 52 of the pin 36 is secured to the block base 22 by tightening a set screw 56 through the at least one fastening screw receiving hole 30 on the side 34 of the block base. The mounting member 24 is drawn tight against the glass panel 14 upon the tightening of the set screw 56 through the at least one fastening screw receiving hole 30 on the side 34 of the block base 22. The bottom edge 46 of the glass panel 14 is configured to set atop the pin 36 with the distal end 52 thereof secured inside the block base 22 such that the glass panel is stabilized between the block base and mounting member 24.

Figure 8:
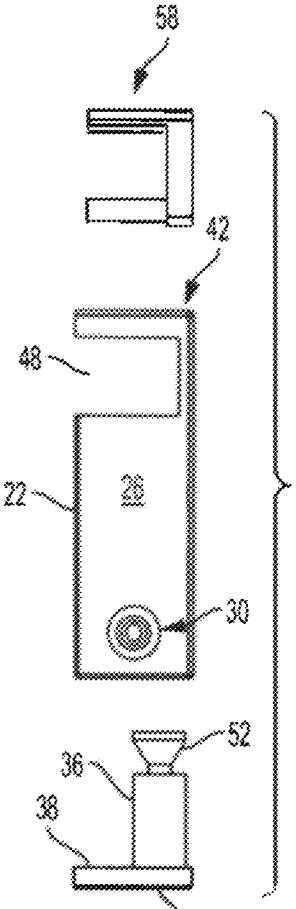
FIG. 8 is a side elevational view of the guide block of FIG. 6.
Figure 7:
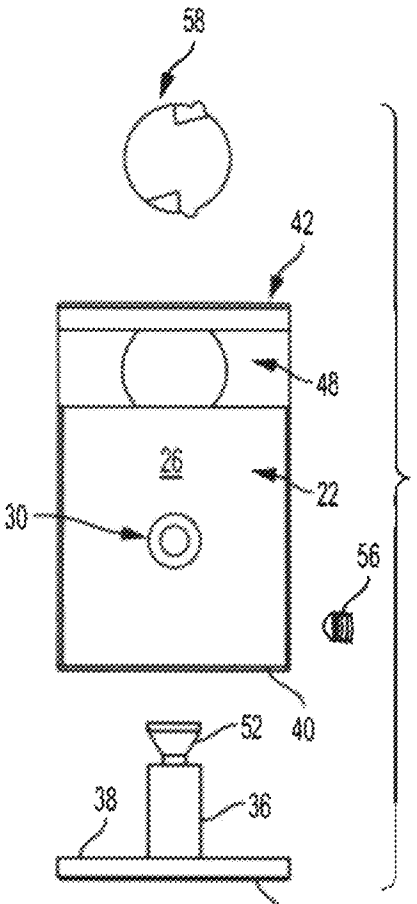
FIG. 7 is a top plan view of the guide block of FIG. 6.
Figure 6:
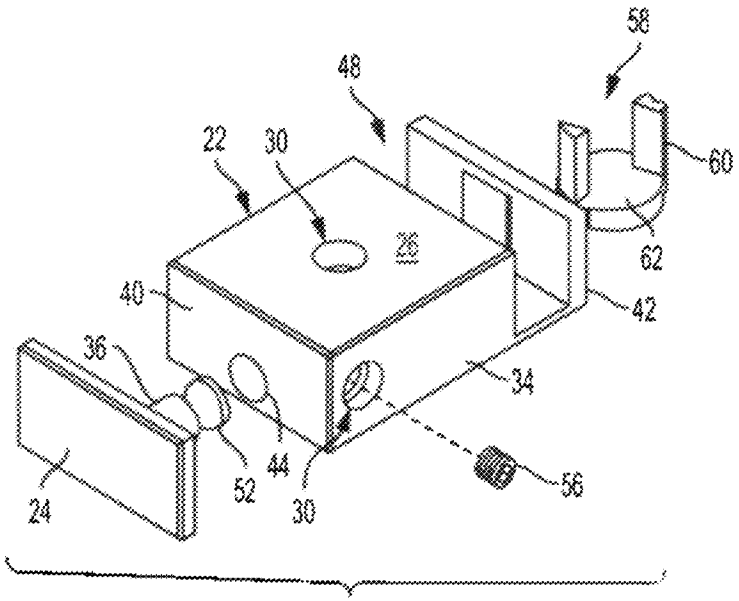
FIG. 6 is a side exploded perspective view of the guide block of FIG. 2.
Figure 11:
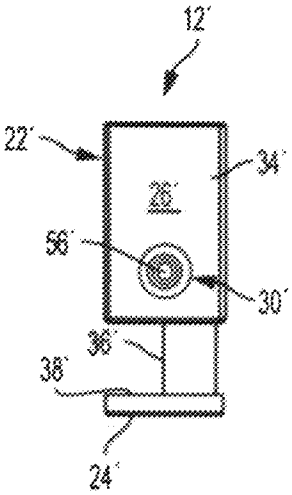
FIG. 11 is a side elevational view of the guide block of FIG. 9.
Figure 10:
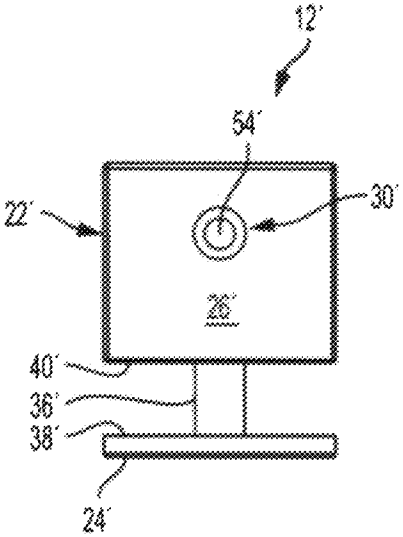
FIG. 10 is a top plan view of the guide block of FIG. 9.
Figure 9:
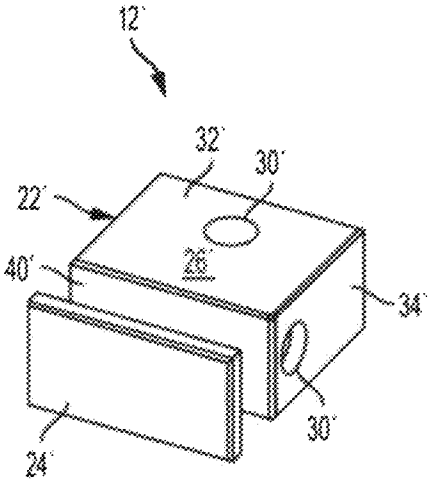
FIG. 9 is a side perspective view of another embodiment of the guide block of FIG. 2 for use with an additional stationary glass panel also shown in FIG. 2 in accordance with the present disclosure.
Figure 14:
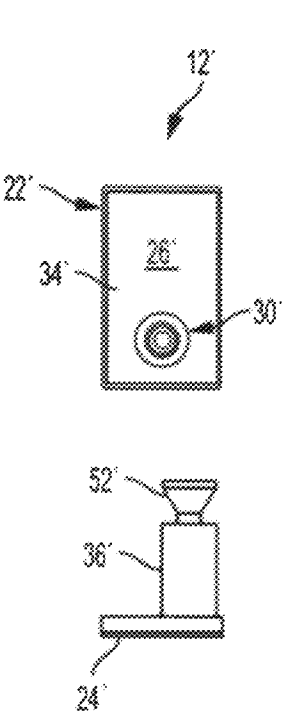
FIG. 14 is a side elevational view of the guide block of FIG. 12.
Figure 13:
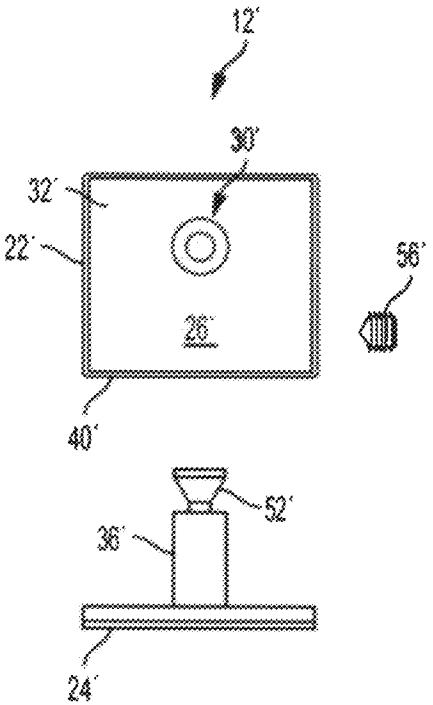
FIG. 13 is a top plan view of the guide block of FIG. 12.
Figure 12:
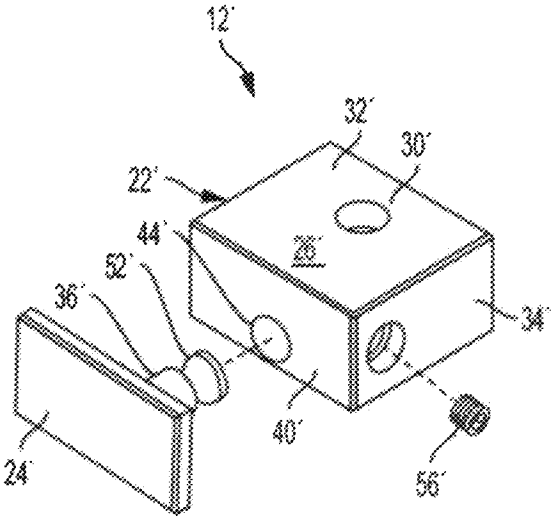
FIG. 12 is a side exploded perspective view of the guide block of FIG. 9.

In some embodiments, the receiving channel 48 is configured to house a sliding base component 58 for stabilizing a glass panel, such as a bottom edge of a sliding glass shower door 16. As shown in FIGS. 6-8, the sliding base component 58 is multi-pronged 60 and disc-shaped 62 such that the bottom edge of the glass door 16 is disposed therebetween the multi-pronged sliding base component to facilitate sliding of the bottom edge of the glass door relative to the surface 28. It should be understood that the sliding base component 58 can be configured of any suitable geometric shape for use in accordance with guide block 12 of the present disclosure.

In accordance with an exemplary embodiment of the present disclosure, there is disclosed a shower enclosure 10 having a glass panel 14 positioned along the surface 28 defined by a shower enclosure threshold frame 50 as shown in FIGS. 1-2. The shower enclosure 10 includes guide block 12 as described above in connection with FIGS. 3-8 with the mounting member 24 and block base 22 configured to stabilize a bottom edge 46 of the glass panel 14 therebetween and the receiving channel 48 configured to stabilize a bottom edge of a sliding glass shower door 16 therebetween such that the glass shower door 16 is slidably disposed within the receiving channel.

Referring now to FIGS. 9-14, the guide block 12' will be described in more detail. FIGS. 9-14 show various views of guide block 12' for use with an additional inline glass panel (shown as a stationary extension glass panel 17 in FIGS. 1-2) in accordance with another embodiment of the present disclosure. The guide block 12' generally includes a block base 22' and a mounting member 24'. The block base 22' has a body 26' of variable size and shape configured for mounting on a surface 28'. The block base 22' has at least one fastening screw receiving hole 30' on top 32' and on a side 34' thereof. The mounting member 24' includes a pin 36' extending therefrom an inner side 38' of the mounting member. The block base 22' has a front 40' such that the front is configured to receive the pin 36' in a hole 44' therethrough such that the block base and the mounting member 24' stabilize the edge 46' of the glass panel 17 disposed therebetween.

In the illustrated embodiment, the block base 22' is geometrically shaped as a square or rectangle. It should be understood that the guide block 12' can be configured of any suitable geometric shape and size. In particular, the guide block 12' can be produced in a wide variety of shapes and still maintain the core functionality, which is the use of one screw hole 30' on the top 32' and one screw hole on the side 34' of the block base 22' and the capacity for the mounting member 24' to be attached to the glass panel 17 after securing the block base.

In some embodiments, the surface 28, 28' is defined by a shower enclosure threshold frame 50 (see FIG. 2). It should be understood that the surface 28, 28' is the floor of the shower enclosure 10.

In some embodiments, the pin 36' is configured to be angled at a distal end 52' thereof. In other embodiments, the pin 36' is configured to be cone-shaped at a distal end 52' thereof. It should be understood that the pin 36' can be configured of any suitable geometric shape in accordance with the present disclosure.

In accordance with an exemplary embodiment of the present disclosure, the block base 22' is mounted to the surface 28' by tightening a screw 54' through the at least one fastening screw receiving hole 30' on the top 32' of the block base 22'.

In accordance with another exemplary embodiment of the present disclosure, the distal end 52' of the pin 36' is secured to the block base 22' by tightening a set screw 56' through the at least one fastening screw receiving hole 30' on the side 34' of the block base. The mounting member 24' is drawn tight against the glass panel 17 upon the tightening of the set screw 56' through the at least one fastening screw receiving hole 30' on the side 34' of the block base 22'. The bottom edge 46' of the glass panel 17 is configured to set atop the pin 36' with the distal end 52' thereof secured inside the block base 22' such that the glass panel 17 is stabilized between the block base 22' and mounting member 24'.

In accordance with another embodiment of the present disclosure, there is disclosed a shower enclosure 10 having a glass panel (shown as a stationary extension glass panel 17) positioned along a surface 28' defined by a shower enclosure threshold frame 50 as shown in FIGS. 1-2. The shower enclosure 10 includes guide block 12' as described above in connection with FIGS. 9-14 with the mounting member 24' and block base 22' configured to stabilize a bottom edge 46' of the glass panel 17 therebetween.

In accordance with the present disclosure, guide blocks 12 and 12' can be fabricated of any suitable sturdy material, such as plastic, metal, metal alloys and the like.

These and other advantages of the present disclosure will be apparent to those skilled in the art. Accordingly, it will be recognized by those skilled in the art that changes or modifications may be made to the above-described embodiments without departing from the broad inventive concepts of the present disclosure. It should therefore be understood that the present disclosure is not limited to the particular embodiments described herein, but is intended to include all changes and modifications that are within the scope and spirit of the disclosure as encompassed by the following claims.

What is claimed is:

1. A guide block for stabilizing an edge of a glass panel relative to a surface, the guide block comprising:

a block base having a body configured for mounting on the surface, the block base defining at least one fastening screw receiving hole on top and at least one fastening screw receiving hole on a side thereof;

a mounting member having a pin extending therefrom an inner side of the mounting member, a distal end of the pin is secured to the block base by tightening a set screw through the at least one fastening screw receiving hole on the side of the block base, the mounting member is configured to be drawn against the glass panel upon the tightening of the set screw through the at least one fastening screw receiving hole on the side of the block base;

wherein the block base has a front and a rear such that the front is configured to receive the pin in a hole therethrough such that the block base and the mounting member are configured to stabilize the edge of the glass panel disposed therebetween and the rear is configured as a receiving channel for stabilizing a bottom edge of a sliding glass door disposed therein.

2. The guide block of claim 1, wherein the block base is geometrically shaped as a square or rectangle.

3. The guide block of claim 1, wherein the surface is defined by a shower enclosure threshold frame.

4. The guide block of claim 1, wherein the pin is angled at the distal end thereof.

5. The guide block of claim 1, wherein the pin is cone-shaped at the distal end thereof.

6. The guide block of claim 1, wherein the block base is mounted to the surface by tightening a screw through the at least one fastening screw receiving hole on the top of the block base.

7. The guide block of claim 1, wherein when the distal end of the pin is secured inside the block base, the pin is configured such that the edge of the glass panel is set atop the pin.

8. The guide block of claim 1, wherein the receiving channel is configured to house a sliding base component for stabilizing the bottom edge of the sliding glass door.

9. The guide block of claim 8, wherein the sliding base component is multi-pronged and disc-shaped such that the bottom edge of the sliding glass door is disposed therebetween prongs of the multi-pronged sliding base component to facilitate sliding of the bottom edge of the sliding glass door relative to the surface.

10. A shower enclosure comprising:

a glass panel positioned along a surface defined by a shower enclosure threshold frame; and a guide block according to claim 1 with the mounting member and block base configured to stabilize a bottom edge of the glass panel therebetween and the receiving channel configured to stabilize the bottom edge of the sliding glass door therebetween such that the sliding glass door is slidably disposed within the receiving channel.

11. A guide block for stabilizing an edge of a glass panel relative to a surface, the guide block comprising:

a block base having a body configured for mounting on the surface, the block base defining at least one fastening screw receiving hole on top and at least one fastening screw receiving hole on a side thereof;

a mounting member having a pin extending therefrom an inner side of the mounting member, a distal end of the pin is secured to the block base by tightening a set screw through the at least one fastening screw receiving hole on the side of the block base, the mounting member is configured to be drawn against the glass panel upon the tightening of the set screw through the at least one fastening screw receiving hole on the side of the block base;

wherein the block base has a front configured to receive the pin in a hole therethrough such that the block base and the mounting member are configured to stabilize the edge of the glass panel disposed therebetween.

12. The guide block of claim 11, wherein the block base is geometrically shaped as a square or rectangle.

13. The guide block of claim 11, wherein the surface is defined by a shower enclosure threshold frame.

14. The guide block of claim 11, wherein the pin is angled at the distal end thereof.

15. The guide block of claim 11, wherein the pin is cone-shaped at the distal end thereof.

16. The guide block of claim 11, wherein the block base is mounted to the surface by tightening a screw through the at least one fastening screw receiving hole on the top of the block base.

17. The guide block of claim 11, wherein when the distal end of the pin is secured inside the block base, the pin is configured such that the edge of the glass panel is set atop the pin.

18. A shower enclosure comprising:

a glass panel positioned along a surface defined by a shower enclosure threshold frame; and a guide block according to claim 11 with the mounting member and block base configured to stabilize the edge of the glass panel therebetween.

* * * * *